US006157875A

United States Patent [19]

Hedman et al.

[11] Patent Number: 6,157,875

[45] Date of Patent: Dec. 5, 2000

[54] IMAGE GUIDED WEAPON SYSTEM AND METHOD

[75] Inventors: Brent R. Hedman, Ridgecrest, Calif.; Charles T. Nash, Springfield, Va.

[73] Assignee: The United States of America as represented by the Secretary of the Navy, Washington, D.C.

[21] Appl. No.: 09/118,096

[22] Filed: Jul. 17, 1998

[51] Int. Cl.[7] ..... G06F 7/00; F42B 25/00

[52] U.S. Cl. ..... 701/1; 701/200; 701/213; 102/382; 244/3.1; 244/3.15; 342/62

[58] Field of Search ..... 701/1, 6, 200, 701/213, 215; 342/62, 64, 67, 357.02, 357.06; 244/3.1, 3.15, 3.2; 102/382

[56] References Cited

U.S. PATENT DOCUMENTS 5,260,709 11/1993 Nowakowski ..... 342/62

*Primary Examiner*—Tan Nguyen
*Assistant Examiner*—Yonel Beaulieu
*Attorney, Agent, or Firm*—Earl H. Baugher, Jr.; Gregory M. Bokar

[57] ABSTRACT

An image guided weapon system employing passive optical terminal guidance and method which provides the precision strike capability without requiring the use of a designator or the presence of an additional designator aircraft, which can operate through the weather, which allows rapid attack of multiple targets, and which does not require any aircraft to remain in the target area after a weapon has been launch. A target area is designated and an image of the target area is generated. An aimpoint within the target area is selected and GPS coordinates of the aimpoint are determined. An image template is generated using flight orientation data, the image of the target area, and GPS coordinates of aimpoint. Image processing software creates an image template which is downloaded to a weapon. The weapon's seeker generates seeker images which are compared to the image template. Once a satisfactory correlation between the image template and the seeker image is made, the aimpoint coordinates are updated and the weapon is guided to the target.

17 Claims, 3 Drawing Sheets

IMAGE GUIDED WEAPON SYSTEM AND METHOD

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

CROSS-REFERENCE TO RELATED APPLICATION

Not Applicable.

MICROFICHE APPENDIX

Not Applicable.

BACKGROUND OF THE INVENTION

1. Field of the Invention

The present invention pertains generally to guided weapon systems, employing passive optical terminal guidance and more particularly to an image guided weapon system and method which provides autonomous precision strike capability employing a digital image.

2. Description of the Prior Art

Previous guided weapons which are launched from aircraft and other vehicles have generally relied on laser seeker/designator systems for weapons guidance. In such laser guided weapons systems, a laser shines laser light onto a target, and a launched bomb, missile or other weapon detects the reflected laser light from the target by a seeker, and guides to the target according to the detected laser light. Laser guided weapons have provided relatively low-cost, precision strike capabilities.

There are, however, significant drawbacks to the use of laser guided weapon systems. Particularly, a laser guided weapon system such as a laser guided bomb (LGB) typically requires the use of two aircraft, with one air craft serving as designator to shine a laser designator on the target, and another aircraft to launch the bomb. Thus, the designating aircraft has to remain in the most dangerous part of the battlespace until bomb impact. Another limitation of LGBs is that the laser designator needs a clear line-of-site to the target area, so LGBs can only be deployed in high visibility conditions. Still another limitation is that targets must be attacked sequentially since only one target can be designated at a time, thus further increasing aircraft exposure. A further limitation is that the designating aircraft must sacrifice a weapon station to carry a laser designator pod, thereby decreasing the strike efficiency of the aircraft.

Accordingly, there is a need for a guided weapon system and method which does not require the use of an additional designator aircraft, which does not require high visibility conditions, which does not require that an aircraft remain in battlespace until weapon impact, which does not require delayed, sequential attack of targets, and which does not require an aircraft to carry a designator pod. The present invention satisfies these needs, as well as others, and generally overcomes the deficiencies found in the background art.

SUMMARY OF THE INVENTION

The present invention is an image guided system and method which provides the precision strike capability without requiring the use of a designator or the presence of an additional designator aircraft, which can operate in low visibility conditions, which allows rapid attack of multiple targets, and which does not require any aircraft to remain in the target area after a weapon has been launched. In general terms, the system of the invention includes means for providing a digital image of a target area, means for providing positional coordinates, means for selecting or determining an aimpoint in the target area, means for creating an image template from the digital image, position coordinates and aimpoint, means for guiding a weapon according to the image template, means correlating images detected by the weapon with the image template, and inertial navigating means for directing the weapon according to the image template and images detected by the weapon. The invention also preferably includes means for detecting aircraft directional or flight orientation, means for generating images from a weapon, means for correlating the images from the weapon with the image template, and navigation means for guiding the weapon to the aimpoint marked on the image template.

By way of example, and not of limitation, the digital image providing means comprises one or more of a variety of conventional imaging devices, including visible, infrared and radar imaging devices which are capable of generating an image of a target area. The image provided may comprise a visible photograph which is acquired days or years in advance, or a synthetic aperture radar (SAR) image which is created on board the weapon-launching aircraft immediately prior to use. If the image produced is in analog form, it is subsequently digitized. The positional coordinate providing means preferably comprises a Global Positioning System (GPS) detector which tracks three dimensional position, velocity and time information according to data from the GPS satellite network. The aimpoint determining means preferably comprises a selecting device, such as a conventional pointing device, used by the aircraft pilot to select an aimpoint within a target area in the digital image. The flight orientation directing means preferably comprises a conventional flight orientation sensor.

The invention includes a mission planner processor, which receives digitized images from the imaging device, positional coordinates from the GPS detector, aim point data from the aimpoint selecting device and flight orientation information from the flight orientation sensor. The image template generating means of the invention generally comprises image processing software, associated with the mission control planner, which marks or tags the digital image with the GPS coordinates of the selected aimpoint. The image template generating means also comprises template generating software, associated with the mission planner, which processes the tagged digital image to generate an image template which contains the GPS coordinates of the aimpoint or target together with easily recognizable features from the digital image.

The means for generating an image from a weapon preferably comprises a fixed or strapdown seeker device associated with the weapon to be launched. The weapon includes an on-board processor which receives the image template from the mission planner via a data link. The weapon processor also receives image data from the strapdown seeker. Software associated with the weapon processor provides means for correlating the images from the weapon with the image template, and means for matching the scale of images from the weapon to the scale of the image template. The navigation means for guiding the weapon to the aimpoint preferably comprises an inertial navigation system and a servo system associated with the weapon.

In operation, a digital image is created on board an aircraft via SAR or forward looking infrared (FLIR), and the pilot selects an aimpoint within the digital image using a pointing device. The GPS coordinates of the selected aimpoint are obtained from the GPS detector, and the digital image, aimpoint and GPS coordinates are communicated to the mission planner processor. The image processing programming marks the aimpoint on the digital image and adds the GPS coordinates of the aimpoint to the digital image. The template generating programming creates an image template which contains the marked aimpoint, GPS coordinates, and easily identifiable features from the digital image. The image template, together with the aircraft flight orientation data, are communicated to the weapon processor just prior to weapon launch. The weapon processor orients the image template according to the aircraft flight orientation data. Following launch, the weapon is guided towards the target area generally using GPS navigation, with the inertial navigation and servo systems of the weapon guiding the weapon according to the GPS tags on the image template and the directional or flight orientation of the aircraft at the time of launch. As the weapon nears the target, the weapon processor rotates the airframe of the weapon so that the fixed seeker on the weapon is pointed towards the aimpoint, and images from the seeker are communicated to the weapon processor. The image correlating software in the weapon processor compares each image received from the seeker to the image template. When a correlation is made between an image from the seeker and the image template, the weapon processor updates the aimpoint according to the GPS location provided by the template. Software in the weapon processor determines approximate range to the aimpoint using the GPS coordinates. Using the range estimate, the features from the seeker images are scaled to features in the image template to match their expected sizes. The inertial navigation system and servo system then guide the weapon to the exact aimpoint.

An object of the invention is to provide an image guided weapons system and method which allows aircraft to operate in a launch and leave manner and does not require additional aircraft to remain in battlespace after launch to designate a target. Another object of the invention is to provide an image guided weapons system and method which does not require clear weather or high visibility to deploy a weapon. Another object of the invention is to provide an image guided weapons system and method which can be deployed in a parallel manner so that multiple weapons can be released at the same time to strike multiple different targets.

Another object of the invention is to provide an image guided weapons system and method which utilizes commercially available off-the-shelf hardware.

Another object of the invention is to provide an image guided weapons system and method which minimizes the application of moving parts.

Another object of the invention is to provide an image guided weapons system and method which reduces aircraft attrition rates.

Another object of the invention is to provide an image guided weapons system and method which permits more effective strike capability for each sortie.

Further objects and advantages of the invention will be brought out in the following portions of the specification, wherein the detailed description is for the purpose of fully disclosing the preferred embodiments of the invention without placing limits thereon.

DESCRIPTION OF THE PREFERRED EMBODIMENT

Figure 1:
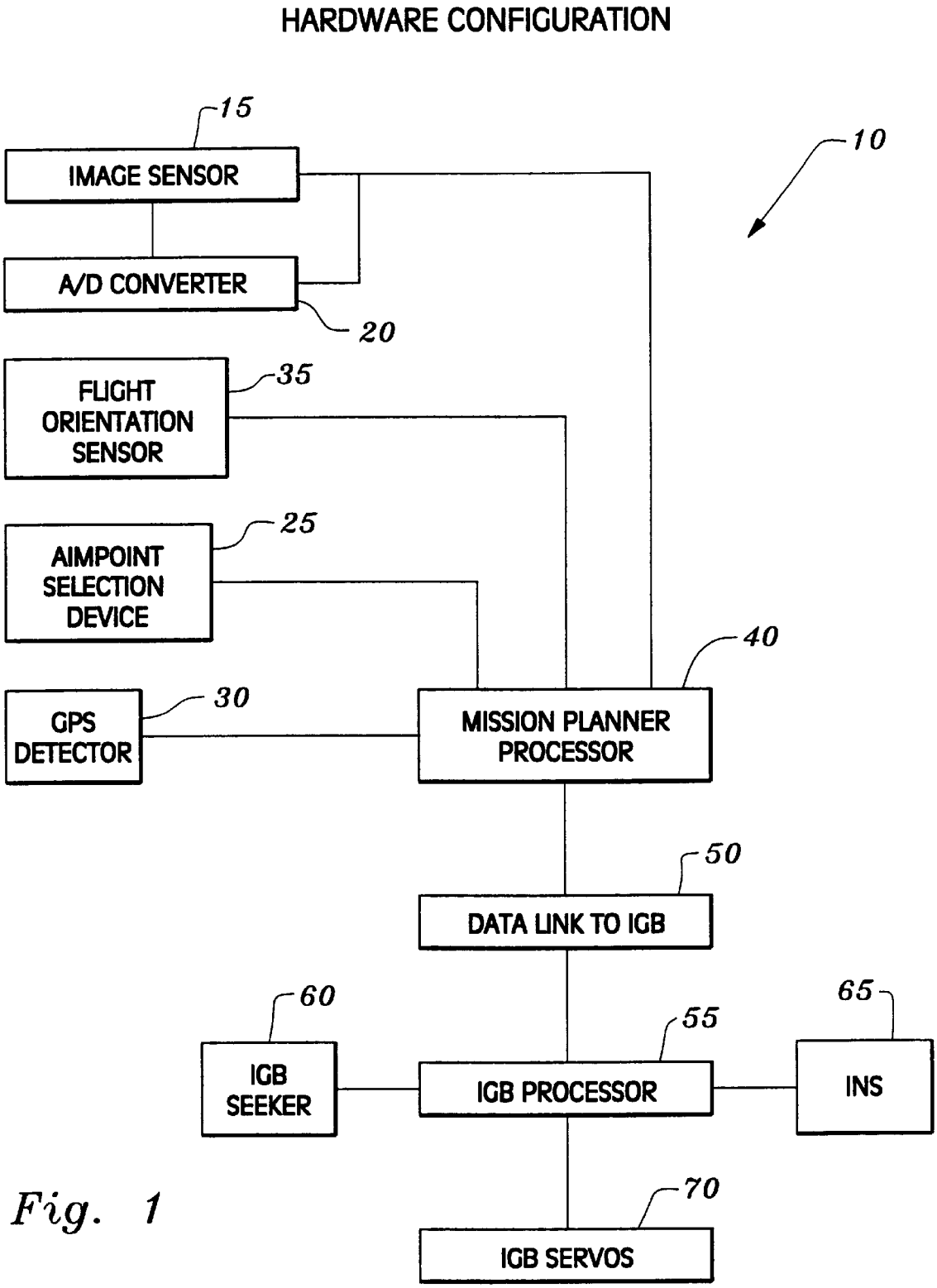
FIG. 1 is a functional block diagram of an image guided weapon system in accordance with the invention.
Figure 2:
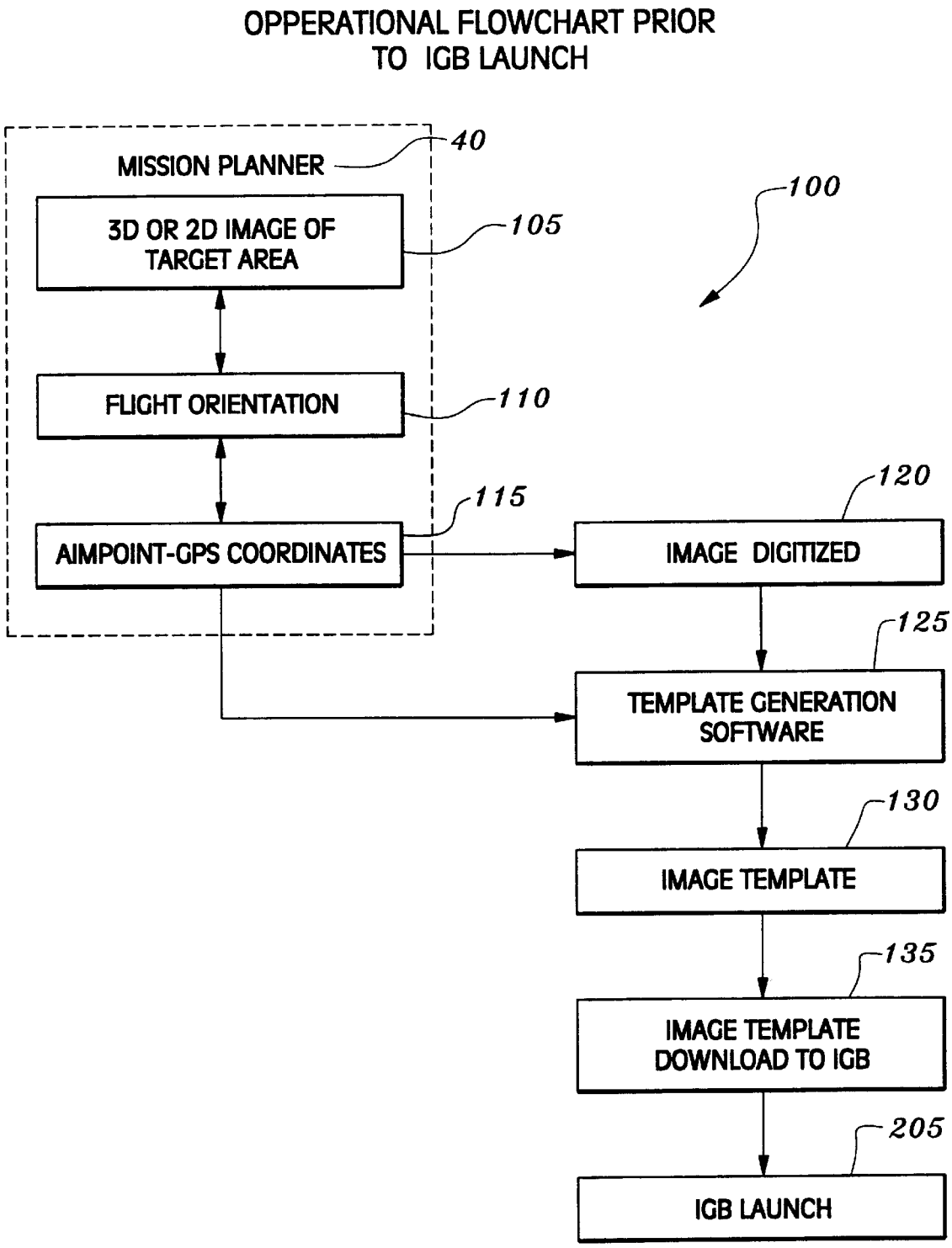
FIG. 2 is an operational flowchart illustrating the method of generating an image template for downloading to an image guided weapon prior to weapon launch.
Figure 3:
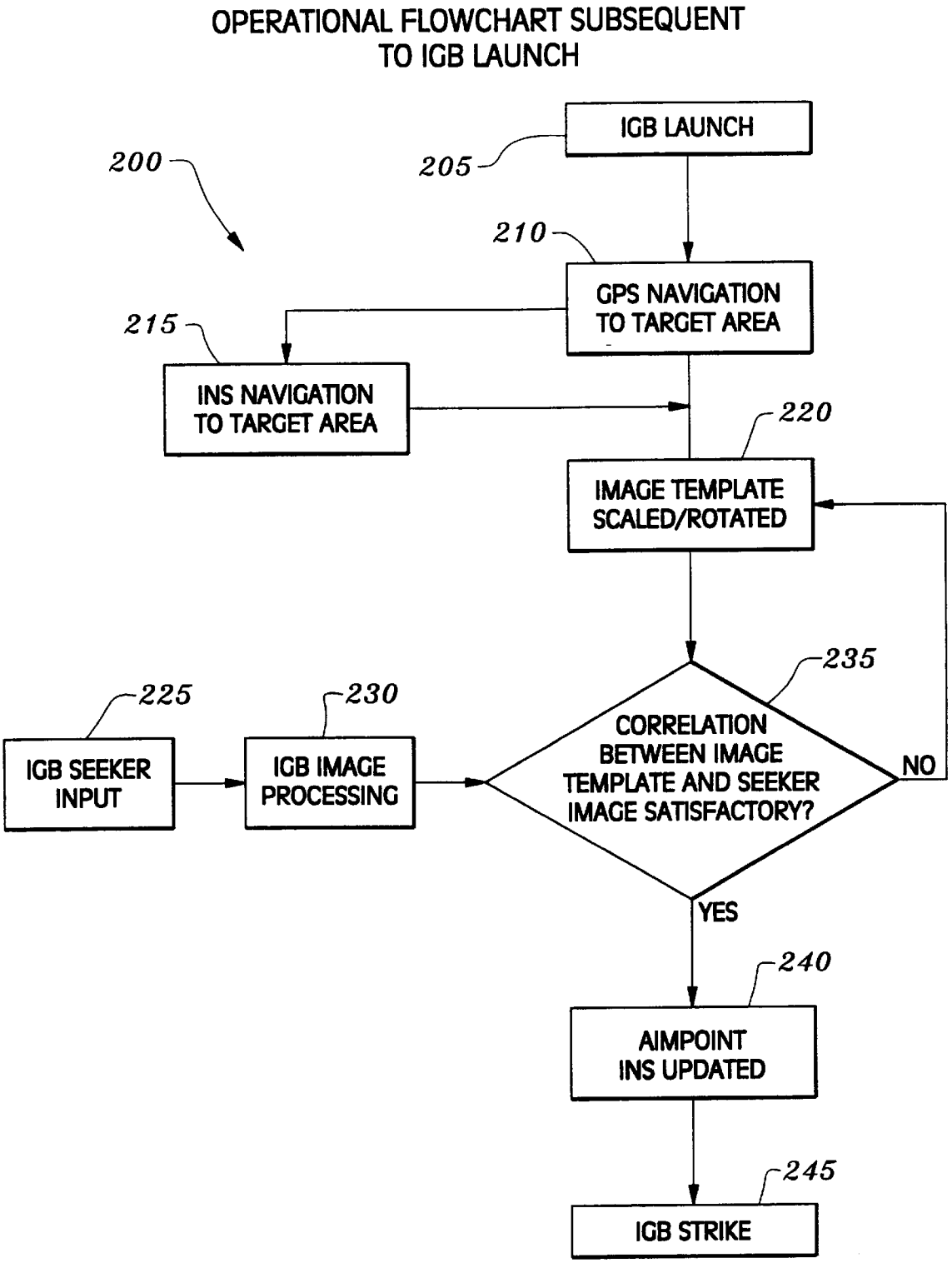
FIG. 3 is an operational flowchart illustrating the method of navigating an image guided weapon after launch.

Referring more specifically to the drawings, for illustrative purposes the present invention is generally shown in the system shown generally in FIG. 1 and the method shown generally in FIG. 2 and FIG. 3. It will be appreciated that the system may vary as to configuration and as to details of the parts, and that the method of using the system may vary as to details and as to the order of steps, without departing from the basic concepts as disclosed herein. The invention is disclosed generally in terms of launching an image guided bomb from an aircraft. However, it will be readily apparent to those skilled in the art that image guided missiles or other weapons may be used with the invention, and the image guided weapons may be launched from land-based vehicles, or submarines, or ships as well as aircraft.

Referring first to FIG. 1, there is shown a functional block diagram of a hardware configuration for an image guided weapon system 10 in accordance with the present invention, which is generally associated with an aircraft (rot shown) and an image guided bomb (IGB) or other weapon (not shown) which is launched from the aircraft. The image guided weapon system 10 includes means for generating images, which are shown generally as image sensor 15. Image sensor 15 creates or generates an image, preferably in digital form, of a target area which includes a target and surrounding geographical features. Image sensor 15 preferably comprises a conventional synthetic aperture radar (SAR) device mounted on or associated with the aircraft, but may alternatively comprise an infrared detector, a satellite image, visible photographic or video imaging equipment, or other radar equipment, which may be located on the aircraft that will ultimately launch a guided weapon, on another aircraft, or on the ground. In the event that the generated image is not in digitized form, a conventional analog to digital converter 20 such as a conventional scanner is provided to digitize analog images. Digital images can be generated immediately prior to use with the invention, or can be generated several years in advance and stored until needed.

Means for selecting an aimpoint for the target in the digital image are provided with the invention, and preferably comprise an aimpoint selection device 25 such as a pointing device. Generally, a pilot utilizes the aimpoint selection device 25 to identify the target aimpoint, which is subsequently marked on the digital image as described further below. The aimpoint may alternatively be selected well in advance by a mission planner, who then physically tags the aimpoint on the image from image detector 15. Means for detecting or generating positional coordinates are included with image guided weapon system 10, and preferably comprise a conventional Global Positioning System (GPS) detector 30 such as those available from Motorola, Inc. GPS detector 30 tracks three dimensional position, velocity and time information according to data from the GPS satellite network. The GPS Detector 30, or other suitable positional coordinate detection means, provides positional coordinates of the aimpoint and the target area. In its preferred embodiment, GPS Detector 30 provides updated positioning coordinates from data generated by aimpoint selection device 25. The use of GPS systems is currently one of the most common positioning methods. The GPS Detector 30 can be used to determine the location of the aircraft, the target area generally, as well as the aimpoint.

The invention includes means for determining directional or flight orientation of the aircraft, which is shown generally as a conventional flight orientation sensor 35 of the type generally used by military and commercial aircraft. Flight orientation sensor 35 provides navigational direction information of the aircraft. The navigational direction can be pre-planned or can be determined during flight by the pilot prior to weapon launch.

A mission planner processor 40 is included with the invention, with mission planner processor 40 interfaced with image sensor 15, A/D converter 20, aimpoint selection device 25, GPS detector 30 and flight orientation sensor 35 via conventional communication links. Mission planner processor 45 receives and processes data gathered from image sensor 15 and A/D converter 20, aimpoint selection device 25, GPS detector 30 and flight orientation sensor 35. Mission planner processor 40 includes conventional random access memory or RAM, read only memory in the form of ROM, PROM or EPROM, and central processor (not shown), which are configured in a conventional manner.

Mission planner processor 40 provides means for generating an image template from the digital image, aimpoint and GPS coordinates provided respectively by image sensor 15, aimpoint selection device 25 and GPS detector 30. The image template generation means further comprises template generating software or programming which carries out image processing operations to create an image template. Preferably, the image template generating software includes program means for carrying out the operations of marking a selected aimpoint onto the digital image from image sensor 15, adding GPS coordinates for the aimpoint from GPS sensor 30 to the digital image, and generating an image template from the digital image, the aimpoint marked on the digital image, and the GPS coordinates added to the digital image. The image template generated by the programming utilizes key geographical features of the digital image which are most easily recognizable, together with the aimpoint and the GPS coordinates for the aimpoint. Preferably, the image template also includes flight orientation data for the aircraft at the time of weapon launch.

Mission planner processor 40, as well as image sensor 15, aimpoint selection device 25 and GPS detector 30, can alternatively be external to the aircraft in cases where image template generation is carried out prior to flight.

A Data link 50 transmits or communicates the image template generated by mission planner processor 40 to a processor associated with the image guided bomb or IGB, shown generally as IGB Processor 55. Data link 50 may be a standard interface bus configuration which is interrupted upon weapon launch, or a conventional wireless or RF (radio frequency) link which uses a RF repeater to broadcast data from mission planner processor 40. Such data links are commonly used by military aircraft. Data link 50 also transmits or communicates directional or flight orientation data from flight orientation sensor 35 and mission planner processor 40 to IGB processor 55.

Seeker means for generating images are associated with the IGB, and are shown generally as IGB seeker 60. The IGB seeker 60 is operatively coupled or interfaced to IGB processor 55. Preferably, IGB seeker 60 is a strap down seeker, with no moving gimballs, and which uses an injection molded strapdown design. The IGB seeker 60 houses an image sensor (not shown) which operates in conditions of clear visibility approximately 2500 feet from the target. The IGB seeker 60 image sensor permits the IGB to fly through clouds and only requires clear visibility when it nears the target. The IGB seeker 60 preferably utilizes an uncooled focal array or other sensor capable of generating real-time seeker images in the IR or visual spectrum at a rate of 15 to 30 frames per second. Such an uncooled focal array IR detector is manufactured by Raytheon.

Navigation means for guiding the IGB or other weapon to the aimpoint are associated with the weapon, and preferably comprise a conventional inertial navigation system or INS 65, and a conventional servo system shown generally as IGB servos 70. Inertial navigation system 65 and IGB servos 70 are interfaced with IGB processor 55. Inertial navigation system 65 utilizes precision gyroscopes and accelerometers in a conventional manner to determine positional and directional information for the IGB, and communicates this information to IGB processor 55. The IGB servos 70, which are controlled by IGB processor 55, preferably comprise a standard JDAM "Tail Kit" of the type used on GPS guided bombs.

The IGB Processor 55 includes conventional random access memory or RAM, read only memory in the form of ROM, PROM or EPROM, and CPU (not shown), which are configured in a conventional manner. The IGB Processor 60 has sufficient memory and speed to process real-time image information received from IGB seeker 60, image template information from mission planner processor 40, inertial navigation system 65 and IGB servos 70, in order to guide the IGB to the aimpoint. Such processors are manufactured by Intel, AMD, Cyrix and other sources. IGB processor correlates the image template with the real-time seeker images as they are sequentially provided from IGB seeker 60, and once a satisfactory correlation is achieved the positional coordinates of the aimpoint are used to update the inertial navigation system 65.

Referring now to FIG. 2 and FIG. 3, as well as FIG. 1, the method of the invention is generally shown. Referring more particularly to FIG. 2 there is shown an operational flowchart 100 of the steps of the method of the invention which occur generally prior to launching the IGB.

At step 105 a three-dimensional or two-dimensional image of the target area is generated or acquired from one of a plurality of sources such as photographs, maps, synthetic aperture radar image, or an infrared image, which are generated by image sensor 15 or another source. The image may be generated on-board, or prior to flight. The image from step 105 should possess sufficient resolution to identify a target area and include distinctive physical characteristics of the target area. The image generally must be digitized as described below. The image provided at step 105 is communicated to and stored by mission planner processor 40.

At step 110, flight directional or orientation data is acquired or generated by flight orientation sensor 35. The flight orientation information is communicated to and stored by mission planner processor 40.

At step 115, the aimpoint is selected and the positional coordinates of the aimpoint are determined. Aimpoint selection 115 is generally carried out by the aircraft pilot using a pointing device. In its preferred embodiment, the positional coordinates of the aimpoint are in GPS coordinates, as described above. The precision of the GPS coordinates is generally low when generated by conventional aircraft sensors, however, GPS precision generated by conventional aircraft-mounted GPS detectors 15 is suitable for the invention. Alternatively, aimpoint selection and acquisition of GPS coordinates can be carried out prior to flight.

At step 120, the image from step 105 is digitized. Note that in many cases image sensor 15 will directly produce an digitized image, and thus step 120 would be carried out generally at the same time as image generation 105. However, if an analog image is used, the analog image must be subsequently digitized in step 120 via A/D converter 20. The mission planner processor 15 utilizes the image of the target area from step 105, the flight orientation data from step 110, and the aimpoint selected in 115. The actual mission may be planned years in advance or by the pilot while the mission is in progress. Thus, the mission planner processor 15 can be at a geographically disparate distance from the aircraft or can be on-board.

At step 125, an image template 130 is generated by template generation software associated with mission planner processor 40. The template generation software processes the digitized image of the target area from step 105 and step 120, the flight orientation data from step 110, and the selected aimpoint and corresponding GPS coordinate from step 115, to create image template 130. The image template 130 is created using image detection algorithms well known in the art of image processing, such as edge detection algorithms and/or region based detection algorithms. The image detection algorithms evaluate and select specific features such as road edges, building edges, trees, streams and other physical characteristics to generate the image template 130. In its preferred embodiment, the image template 130 also includes flight orientation 110 data and aimpoint GPS coordinate 115 data.

At step 135, the image template 130 generated at step 125 is downloaded to the weapon or IGB from mission planner processor 40 via data link 50. This step may be carried out in flight just prior to launch or prior to flight in cases where mission planner processor 40 is external to the aircraft.

At step 205 the aircraft pilot flies the IGB to an acceptable location and launches the IGB.

Referring now more particularly to FIG. 3, there is shown an operational flowchart 200 of the steps of the method which generally occur subsequent to launching the IGB at step 205.

At step 210, following launch at step 205, the IGB processor 55 navigates the IGB to the target area using the GPS coordinates of the aimpoint provided by image template 130.

At step 215, the inertial navigation system 65 of the IGB is also used to navigate the IGB to the target area aimpoint according to the GPS coordinates. Generally, the IGB processor 55 employs GPS and/or INS navigation to guide the IGB to a set location adjacent or near the target.

At step 220, the IGB processor 55 rotates the airframe of the IGB and points the IGB Seeker 60 towards the actual target area.

At step 225, IGB Seeker 60 collects seeker input data from the target area in the form of multiple real-time images and communicates these seeker images to IGB processor 55. As noted above, IGB seeker preferably generates sequential images of the target area at a rate of fifteen to thirty frames or images per second.

At step 230, the seeker-generated images of the target area from step 225 are processed by IGB processor 55 via conventional image processing 230 software.

At step 235, IGB processor 55 compares and correlates the image template 130 with each seeker image obtained in step 225 and processed in step 230. If a satisfactory correlation between the image template and a seeker image, step 240 below is carried out. If no correlation of the image template and the seeker image is made, step 220 is repeated wherein the image template is again scaled and rotated, and then step 235 is carried out again with the next sequential seeker image being compared to the image template. Once a satisfactory correlation is made between the image template 130 and seeker image, step 240 is carried out in which IGB processor 55 updates the positional coordinates of the aimpoint of the IGB by using inertial navigation system 65 to calculate a setoff distance in inertial space. The setoff distance is based on or reference to the GPS navigation coordinates used in 210 and/or INS navigation coordinates used in step 215. The setoff distance provides a precise aimpoint within 3 meters from the exact target. The IGB then strikes the target at step 245.

Accordingly, it will be seen that this invention provides an image guided weapon system which provides the precision strike capabilities of laser guided weapons systems without requiring the use of a designator or the presence of an additional designator aircraft, which can operate through the weather, which allows rapid attack of multiple targets, and which does not require aircraft to remain in the target area after a weapon has been launch. Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A system for guiding a weapon employing passive optical terminal guidance, comprising:

(a) an imaging device that generates a digital image of a target area;

(b) an aimpoint selection device that selects an aimpoint in said target area;

(c) a GPS detector that establishes positional coordinates;

(d) a first processor that generates an image template from said digital image, said aimpoint, and said positional coordinates;

(e) a seeker onboard said weapon, that generates real-time images of said target area; and (f) a second processor that correlates said image template with said real-time images from said seeker.

2. A system for guiding a weapon as recited in claim 1, wherein said first processor comprises a mission planner processor, said mission planner processor interfaced with said imaging device, said aimpoint selection device, and said detector.

3. A system for guiding a weapon as recited in claim 1, wherein said second processor for correlating said image template with said real-time images from said seeker comprises a weapon processor, said weapon processor onboard said weapon, said weapon processor interfaced with said mission planner processor and said seeker, said weapon processor including image correlating software.

4. A system for guiding a weapon as recited in claim 3, further comprising a navigation device for guiding said weapon to said aimpoint according to said image template and said real-time images from said seeker, said navigation device interfaced with said weapon processor.

5. A system for guiding a weapon as recited in claim 2, further comprising an inertial navigation system (INS), said INS interfaced with said mission planner processor.

6. A system for guiding a weapon as recited in claim 3, wherein said mission planner processor further comprises image template generating software, said image template generating software comprising:

a) a first program for marking an aimpoint from said aimpoint selection device into a digital image from said imaging device;

b) a second program for adding positional coordinates from said detector to said digital image; and c) a third program for generating an image template form said digital image, said aimpoint marked on said digital image, and said positional coordinates added to said digital image.

7. A system for guiding a weapon as recited in claim 4, wherein said navigation device comprises:

(a) an inertial navigation system (INS) for updating positional coordinates of said weapon; and (b) a servo system for steering said weapon.

8. A system for guiding a weapon employing passive optical terminal guidance, comprising:

(a) an imaging device that generates a digital image of a target area;

(b) an aimpoint selection device that selects an aimpoint in said target area;

(c) a GPS detector that establishes GPS coordinates;

(d) a first processor that generates an image template from said digital image, said aimpoint, and said GPS coordinates;

(e) a seeker onboard said weapon, that generates real-time images of said target area;

(f) a second processor that correlates said image template with said real-time images from said seeker; and (g) a navigation device that guides said weapon to said aimpoint using said image template and said real-time images from said seeker.

9. A system for guiding a weapon as recited in claim 8, wherein said first processor comprises a mission planner processor, said mission planner processor interfaced with said imaging device, said aimpoint selection device, and said GPS detector.

10. A system for guiding a weapon as recited in claim 9, further comprising an inertial navigation system (INS), said INS interfaced with said mission planner processor.

11. A system for guiding a weapon as recited in claim 10, wherein said mission planner processor further comprises image template generating software, said image template generating software comprising:

(a) a first program for marking an aimpoint from said aimpoint selection device into a digital image from said imaging device;

(b) a second program for adding said GPS coordinates from said GPS detector to said digital image; and (c) a third program for generating an image template form said digital image, said aimpoint marked on said digital image, and said GPS coordinates added to said digital image.

12. A system for guiding a weapon as recited in claim 8, wherein said second processor for correlating said image template with said real-time images from said seeker (means) comprises a weapon processor, associated with said weapon, said weapon processor interfaced with a mission planner processor, said weapon processor interfaced with said navigation device, said weapon processor including image correlating software.

13. A system for guiding a weapon as recited in claim 12, wherein said navigation device comprises:

(a) an inertial navigation system (INS) for updating said GPS coordinates of said weapon; and (b) a servo system for steering said weapon.

14. A method for guiding a weapon employing passive optical terminal guidance to a target, comprising the steps of:

(a) generating a digital image of a target to include an area surrounding said target;

(b) selecting an aimpoint to designate said target;

(c) acquiring GPS coordinates for said aimpoint;

(d) generating an image template from said digital image, said aimpoint, and said GPS coordinates;

(e) detecting images of said target with a passive optical seeker onboard said weapon; and (f) correlating said images from said passive optical seeker with said image template.

15. A method for guiding a weapon to a target as recited in claim 14, further comprising the steps of rotating and scaling said image template.

16. A method for guiding a weapon to a target as recited in claim 15, further comprising the step of downloading said image template to said weapon.

17. A method for guiding, a weapon to a target as recited in claim 16, further comprising the step of navigating said weapon to said aimpoint according to said correlated images from said passive optical seeker and said downloaded, rotated, and scaled image template.

* * * * *